US006734612B2

(12) United States Patent
Im et al.

(10) Patent No.: US 6,734,612 B2
(45) Date of Patent: May 11, 2004

(54) TENSION MASK ASSEMBLY FOR FLAT CATHODE RAY TUBE

(75) Inventors: Young-Bin Im, Suwon (KR); Nozomu Arimoto, Suwon (KR); Do-Hun Pyun, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/998,826

(22) Filed: Dec. 3, 2001

(65) Prior Publication Data

US 2002/0067117 A1 Jun. 6, 2002

(30) Foreign Application Priority Data

Dec. 4, 2000 (KR) ..... 2000-72936

(51) Int. Cl.[7] ..... H01J 29/80
(52) U.S. Cl. ..... 313/407; 313/402; 313/403
(58) Field of Search ..... 313/402–408

(56) References Cited

U.S. PATENT DOCUMENTS 5,856,725 A * 1/1999 Ueda ..... 313/402
6,388,370 B1 * 5/2002 Ohmae ..... 313/403
6,433,468 B1 * 8/2002 Shinoda ..... 313/403
6,577,047 B2 * 6/2003 Ohmae et al. ..... 313/402
2001/0050524 A1 * 12/2001 Choe et al. ..... 313/402
2002/0014821 A1 * 2/2002 Kobayashi et al. ..... 313/402
2002/0050777 A1 * 5/2002 Kim et al. ..... 313/402

FOREIGN PATENT DOCUMENTS

JP 52022474 A * 2/1977 ..... H01J/29/07

* cited by examiner

*Primary Examiner*—Nimeshkumar D. Patel
*Assistant Examiner*—German Colón
(74) *Attorney, Agent, or Firm*—Robert E. Bushnell, Esq.

(57) ABSTRACT

A tension mask assembly for a flat cathode ray tube includes a tension mask having a plurality of strips separated from one another by a predetermined gap, real bridges connecting adjacent strips to thus define slots through which electron beams pass, and first and second dummy bridges extending from adjacent strips toward each slot therebetween, the tension mask being installed such that its top surface faces a panel forming a screen and it is separated from the panel by a predetermined gap, a plurality of supporting members disposed at opposite sides of the tension mask to support the tension mask, and a plurality of rigid members secured to opposite ends of the supporting members to apply tension to the tension mask. A first etching boundary formed at an end of the first dummy bridge near to the center of the tension mask is lower with respect to the screen than a second etching boundary formed at an end of the second dummy bridge near to the periphery of the tension mask. The shape of a section of a slot having dummy bridges are formed such that an electron beam is prevented from passing through the slot, thereby solving the problem of visibility. Therefore, cathode ray tubes having a high definition can be manufactured.

20 Claims, 9 Drawing Sheets

TENSION MASK ASSEMBLY FOR FLAT CATHODE RAY TUBE

This application makes reference to, incorporates the same herein, and claims all benefits accruing under 35 U.S.C. § 119 from an application for TENSION MASK FOR FLAT CATHODE RAY TUBE earlier filed in the Korean Industrial Property Office on Dec. 4, 2000, and there duly assigned Serial No. 2000-72936 by that Office.

BACKGROUND OF THE INVENTION

1. Field of the Invention

The present invention relates to a cathode ray tube, and more particularly, to a tension mask assembly having a slot of an improved structure, in which a dummy bridge is formed, and having a color selecting function for a flat cathode ray tube.

2. Description of the Related Art

Generally, a flat cathode ray tube includes a panel having a flat screen and a funnel having is an electronic gun at a neck portion and a deflection yoke at a cone portion. Such a cathode ray tube employs a tension mask for accurately landing red, green and blue electron beams emitted from the electron gun on the phosphor screen. The tension mask is disposed to be a predetermined gap apart from a phosphor screen formed on the inner surface of the panel.

An exemplar of the art U.S. Pat. No. 4,926,089 issued to Moore for Tied Slit Foil Shadow Mask with False Ties discloses a tension mask.

The tension mask includes a plurality of strips which is formed on a metal foil such that they are separated from one another at predetermined intervals, slots intermittently formed between the strips for allowing many electron beams to pass, real bridges for supporting the slots, and dummy bridges extending from the strips to the slots. At least one dummy bridge is formed for each slot.

A plurality of dummy bridges extending from opposite strips toward the center of the slot are formed along the opposite borders of the slot. The dummy bridges face the center of the slot at the strip so that they are located on opposed sides of the slot. Accordingly, a width of the slot in which dummy bridges are not formed is different from a width of the slot at which the dummy bridges are formed.

A tension mask having such a structure is formed by an etching method. An etching process is performed so that a clipping phenomenon, in which an electron beam emitted from an electron gun can be blocked by the tension mask, is suppressed at a portion of the slot in which the dummy bridge is not formed. In other words, to prevent an electron beam from colliding with the strip, an etching process is performed such that a lower end surface of a first strip is less etched than an upper end surface thereof in a direction in which an electron beam is deflected and a lower end surface of a second strip is less etched than the lower end surface of the first strip. Accordingly, an electron beam can pass through the slot without being clipped.

For a portion of the slot in which the dummy bridge is formed, a lower end surface of a first dummy bridge is more etched than an upper end surface thereof and an upper end surface of a second dummy bridge is more etched than a lower end surface thereof. As a result, although the width of the portion of the slot in which the dummy bridges are formed is narrower than the width of the portion of the slot in which the dummy bridges are not formed, a deflected electron beam can pass through the portion of the slot having the dummy bridges.

A conventional tension mask has the following problems. During a procedure in which electron beams emitted from an electron gun pass through slots and then land on the phosphor screen of a panel so as to display an image on a screen, passing of electron beams occurs at portions where dummy bridges are formed so that traces appearing due to real bridges and dummy bridges which shade the phosphor screen cannot be uniform. Consequently, the problem of visibility cannot be overcome completely. Therefore, it is desired to change the shape of a slot at which a dummy bridge is formed in order to solve the problem of visibility.

In addition, in order to adjust the degree of a shadow occurring when a deflected electron beam passes through the portion of each slot having dummy bridges, it needs to form a long dummy bridge. Accordingly, a design margin of a dummy bridge is deficient.

SUMMARY OF THE INVENTION

It is therefore an object of the present invention to provide a tension mask assembly for a flat cathode ray tube, in which the structure of a dummy bridge formed at a slot is improved to completely solve a visible line problem so that the definition of an image can be improved.

It is another object to provide a tension mask assembly that is easy to manufacture.

It is another object to have a tension mask that is inexpensive to manufacture.

It is yet another object to have a tension mask that can accommodate the manufacture of a high definition cathode ray tube.

Accordingly, to achieve the above object of the invention, there is provided a tension mask assembly for a flat cathode ray tube. The tension mask assembly includes a tension mask having a plurality of strips separated from one another by a predetermined gap, real bridges connecting adjacent strips to thus define slots through which electron beams pass, and first and second dummy bridges extending from adjacent strips toward each slot therebetween, the tension mask being installed such that its top surface faces a panel forming a screen and it is separated from the panel by a predetermined gap, a plurality of supporting members disposed at opposite sides of the tension mask to support the tension mask, and a plurality of rigid members secured to opposite ends of the supporting members to apply tension to the tension mask. A first etching boundary formed at an end of the first dummy bridge near to the center of the tension mask is lower with respect to the screen than a second etching boundary formed at an end of the second dummy bridge near to the periphery of the tension mask.

In addition, the vertical center axis of an etched area at the upper end surfaces of the first and second dummy bridges is offset from the vertical center axis of an etched area at the lower end surfaces of the first and second dummy bridges toward the center of the tension mask so that a deflected electron beam can be blocked. The amount of offset increases from the center of the tension mask toward the periphery thereof.

Moreover, an etched area at the upper end surfaces of the first and second dummy bridges is wider than an etched area at the lower end surfaces of the first and second dummy bridges.

Furthermore, an etched area at an upper surface above the first etching boundary of the first dummy bridge is wider than an etched area at a lower surface therebelow, and an etched area at a lower surface below the second etching boundary of the second dummy bridge is wider than an etched area at an upper surface thereabove.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PRESENT INVENTION

Figure 1:
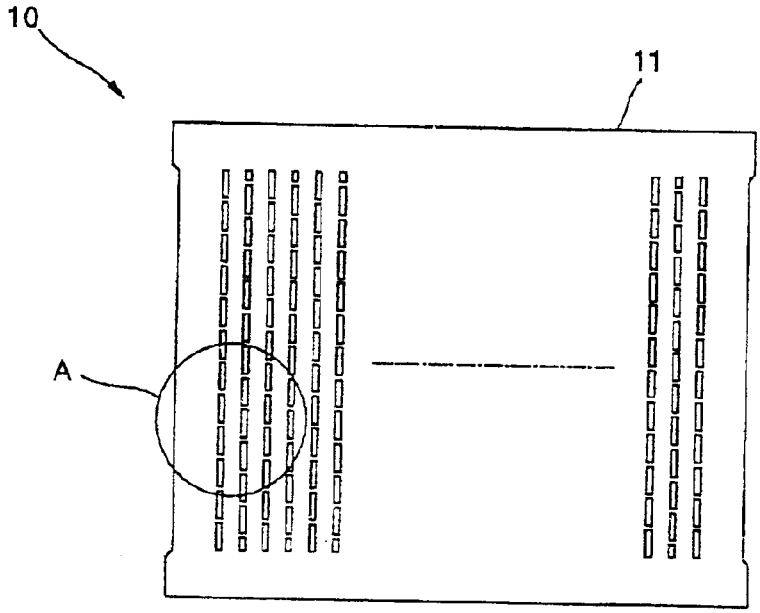
FIG. 1 is a plan view of an earlier tension mask.
Figure 2:
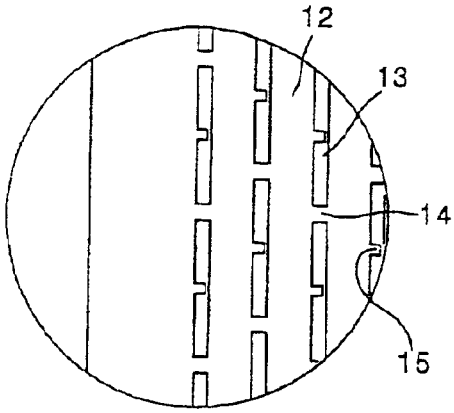
FIG. 2 is an enlarged plan view of the part A of FIG. 1.

Turning now to the drawings, referring to FIGS. 1 and 2, the tension mask 10 includes a plurality of strips 12 formed on a metal foil 11 such that they are separated from one another at predetermined intervals, slots 13 intermittently formed between the strips 12 for allowing many electron beams to pass, real bridges 14 for supporting the slots 13, and dummy bridges 15 extending from the strips 12 to the slots 13. At least one dummy bridge 15 is formed for each slot 13.

Figure 3:
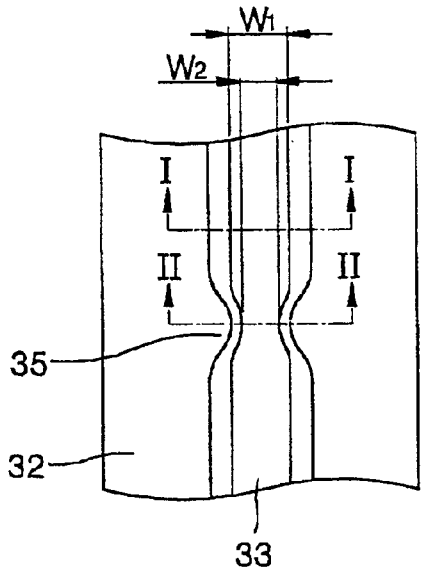
FIG. 3 is a plan view of a slot in which an earlier dummy bridge is formed.

FIG. 3 illustrates a slot 33 in which a dummy bridge 35 is formed. Referring to FIG. 3, a plurality of dummy bridges 35 extending from opposite strips 32 toward the center of the slot 33 are formed along the opposite borders of the slot 33. The dummy bridges 35 face the center of the slot 33 at the strip 32 so that they are located on opposed sides of the slot 33. Accordingly, a width $W_1$ of the slot 33 is different from a width $W_2$ of the slot 33 at which the dummy bridges 35 are formed, and the width $W_1$ is larger than the $W_2$.

Figure 4A:
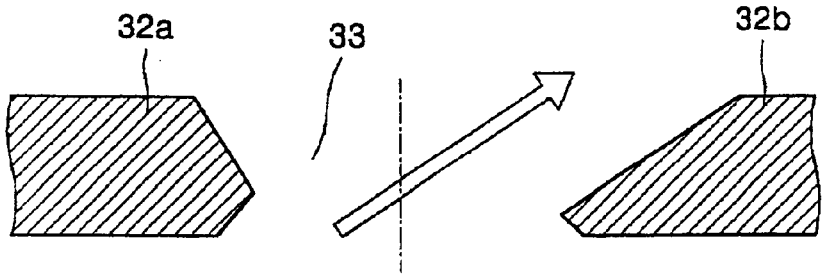
FIG. 4A is a sectional view taken along the line 1—1 of FIG. 3.
Figure 4B:
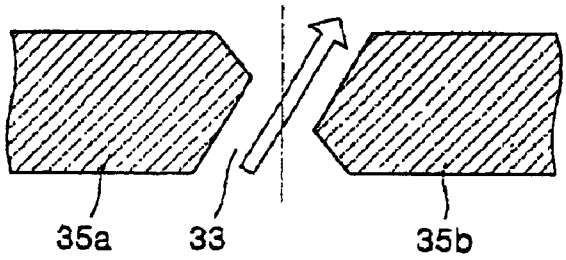
FIG. 4B is a sectional view taken along the line II—II of FIG. 3.

A tension mask having such a structure is formed by an etching method. FIG. 4A is a sectional view taken along the line I—I of FIG. 3, and FIG. 4B is a sectional view taken along the line II—II of FIG. 3. Referring to FIG. 4A, an etching process is performed so that a clipping phenomenon, in which an electron beam emitted from an electron gun can be blocked by the tension mask, is suppressed at a portion of the slot 33 in which the dummy bridge 35 is not formed. In other words, to prevent an electron beam from colliding with the strip 32, an etching process is performed such that a lower end surface of a first strip 32*a* is less etched than an upper end surface thereof in a direction (an arrow-headed direction) in which an electron beam is deflected and a lower end surface of a second strip 32*b* is less etched than the lower end surface of the first strip 32*a*. Accordingly, an electron beam can pass through the slot 33 without being clipped.

As shown in FIG. 4B, for a portion of the slot 33 in which the dummy bridge 35 is formed, a lower end surface of a first dummy bridge 35*a* is more etched than an upper end surface thereof and an upper end surface of a second dummy bridge 35*b* is more etched than a lower end surface thereof. As a result, although the width $W_2$ of the portion of the slot 33 in which the dummy bridges 35 are formed is narrower than the width W, of the portion of the slot 33 in which the dummy bridges 35 are not formed, a deflected electron beam can pass through the portion of the slot 33 having the dummy bridges 35, as marked by the arrow.

Figure 5:
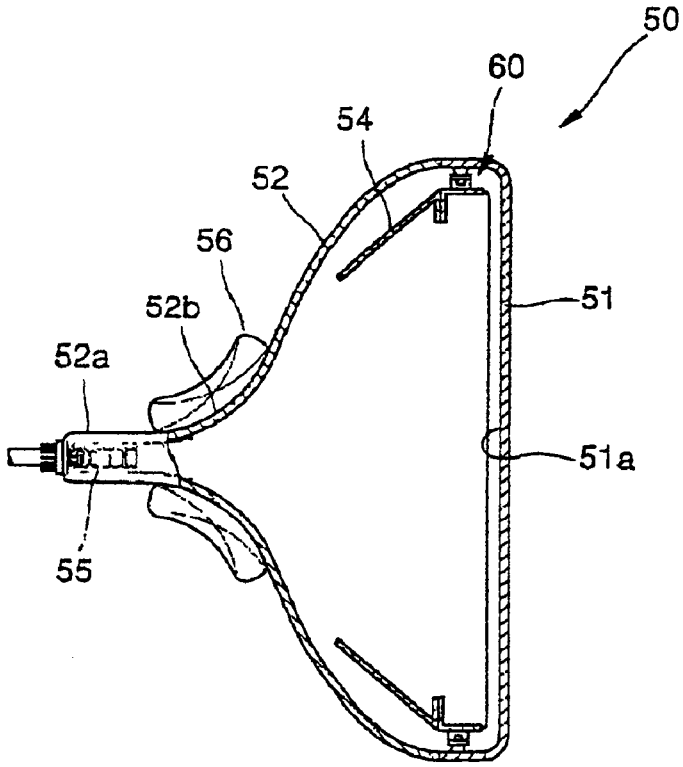
FIG. 5 is an sectional elevation view of a cathode ray tube according to an embodiment of the present invention.

FIG. 5 is an sectional elevation view of a cathode ray tube 50 according to an embodiment of the present invention. Referring to FIG. 5, the cathode ray tube 50 includes a panel 51 which has a phosphor screen 51*a* on its inside, and a funnel 52 which is mounted on the panel 51 to thus form a bulb. A tension mask assembly 60 is installed on the inside of the panel 51. An inner shield 54 is secured to the tension mask assembly 60. Here, the front side of the panel 51 forms a screen on which images are displayed.

An electron gun 55 for emitting electron beams to the phosphor screen 51*a* is sealed in a neck portion 52*a* of the funnel 52. A deflection yoke 56 is installed in a cone portion 52*b* of the funnel so that an electron beam can be deflected and projected to a proper position on the phosphor screen 51*a*.

Figure 6:
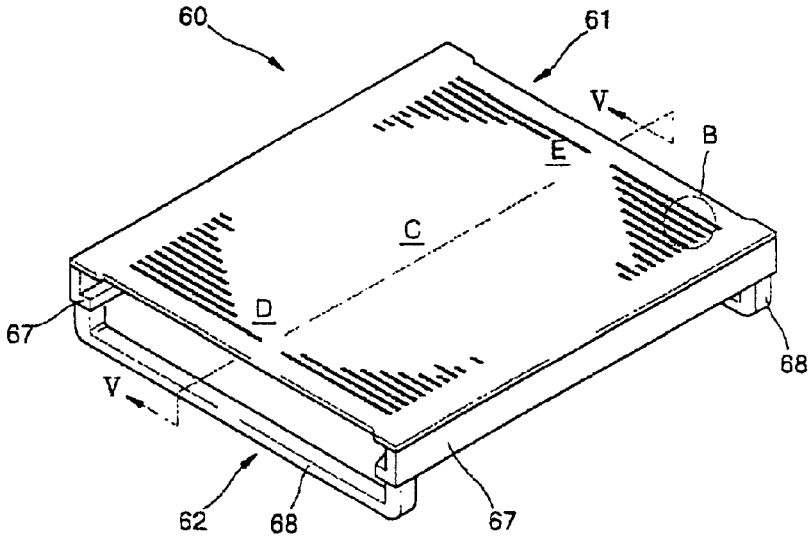
FIG. 6 is a perspective view of a tension mask assembly of FIG. 5.
Figure 7:
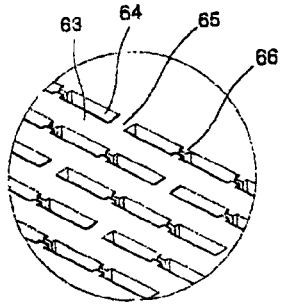
FIG. 7 is an enlarged perspective view of the part B of FIG. 6.

FIG. 6 is a perspective view of the tension mask assembly 60 of FIG. 5. FIG. 7 is an enlarged perspective view of the part B of FIG. 6. Referring to FIGS. 6 and 7, the tension mask assembly 60 includes a tension mask 61 and a frame 62 supporting the tension mask 61.

The tension mask 61 is formed of a metal foil. A plurality of strips 63 are formed on the front surface of the tension mask 61 to be separated from one another by a predetermined gap. Many strip-shaped slots 64 are intermittently formed among the strips 63 so that an electron beam emitted from an electron gun can pass through each slot 64. A real bridge 65 is formed between adjacent slots 64 to support the slots 64. A dummy bridge 66 extending from each strip 63 toward the center of each slot 64 is formed at each of the opposed sides of the slot 64.

The frame 62 includes a plurality of supporting members 67 for supporting the tension mask 61 in a lengthwise direction. The supporting members 67 are disposed to face each other. Two rigid members 68 for applying tension to the tension mask 61 are secured to opposite ends of the supporting members 67 such that the rigid members 68 connect the supporting members 67.

Figure 8:
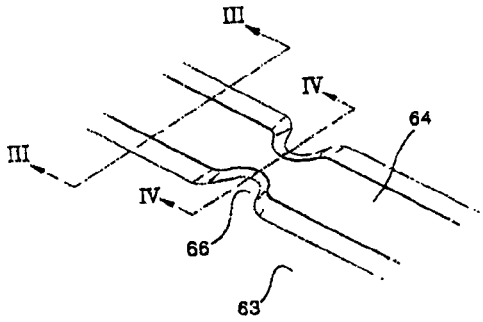
FIG. 8 is a perspective view of a portion of a slot at which a dummy bridge shown in FIG. is formed.

FIG. 8 is a perspective view of a portion of the slot 64 at which the dummy bridge 66 shown in FIG. 7 is formed. Referring to FIG. 8, the dummy bridges 66 are formed along the border of the slot 64 at the opposed sides of the slot 64 such that one end of each dummy bridge 66 is connected to the strip 63 and the other end extends toward the center of the slot 64. The dummy bridges 66 are formed to be perpendicular to the strip 63 and to face the center of the slot 64. The width of the slot 64 at which the dummy bridges 66 are formed is narrower than the width of the slot 64 at which the dummy bridges 66 are not formed.

Figure 9A:
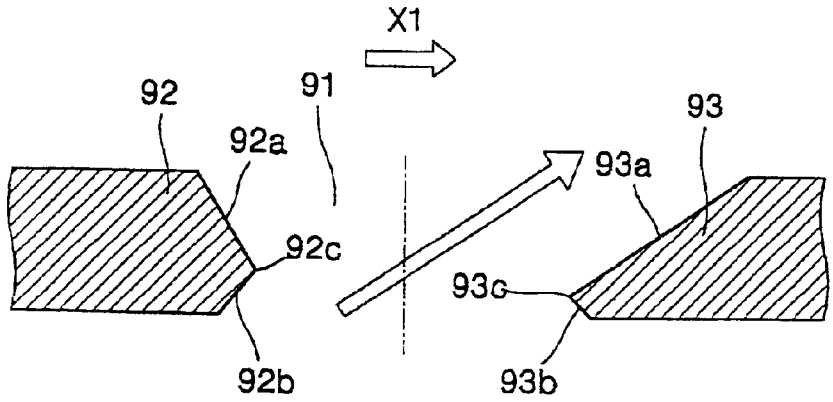
FIG. 9A is a sectional view taken along the line III—III of FIG. 8.
Figure 9B:
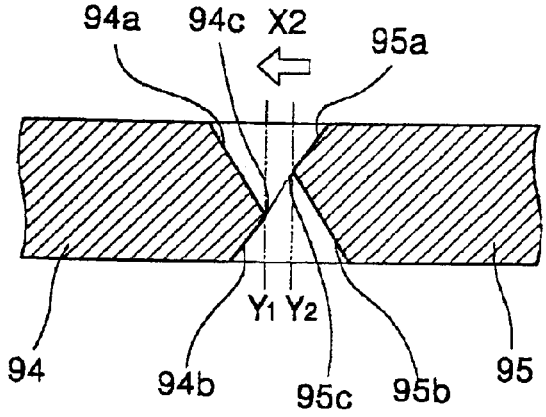
FIG. 9B is a sectional view taken along the line IV—IV of FIG. 8 and shows an etching step.
Figure 9C:
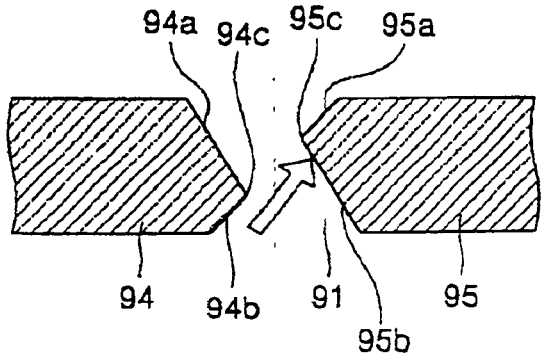
FIG. 9C is a sectional view taken along the line IV—IV of FIG. 8 and shows a state after the etching step according to a first embodiment of the present invention.

Here, the slot 64 is formed by etching so that clipping of an electron beam can be suppressed and the problem of visibility can be solved. This is shown in FIGS. 9A through 9D in more detail. FIG. 9A is a sectional view taken along the line III—III of FIG. 8. FIG. 9B is a sectional view taken along the line IV—IV of FIG. 8 and shows an etching step. FIG. 9C is a sectional view taken along the line IV—IV of FIG. 8 and shows a state after the etching step according to a second embodiment of the present invention.

Referring to FIG. 9A, a slot 91 having no dummy bridges is formed by etching a first strip 92 and a second strip 93 in different ways in an arrow-headed direction in which an electron beam is deflected and passes through the slot 91 so that a clipping phenomenon occurring when an electron beam hits a strip can be suppressed. Here, the first strip 92 is nearer to the center of the tension mask 61 of FIG. 6 than the second strip 93, and the second strip 93 is nearer to the periphery of the tension mask 61 than the first strip 92.

An etched area at upper end surfaces 92*a* and 93*a* of the first and second strips 92 and 93 is wider than an etched area at lower end surfaces 92*b* and 93*b* of the first and second strips 92 and 93. Here, the top surfaces of first and second strips 92 and 93 face the screen formed on the front side of the panel 51 of FIG. 5. In addition, the central axis of the etched area at the upper end surfaces 92*a* and 93*a* of the respective first and second strips 92 and 93 is offset toward the periphery (in an X1 direction) of the tension mask 61 from the central axis of the etched area at the lower end surfaces 92*b* and 93*b* of the respective first and second strips 92 and 93. The offset in the X1 direction allows a deflected electron beam to pass through the portion of the slot 91 which does not have a dummy bridge.

For this, the upper end surface 92*a* of the first strip 92 is more etched than the lower end surface 92*b* thereof, and the upper end surface 93*a* of the second strip 93 is more etched than the lower end surface 93*b* thereof. Accordingly, a first etching boundary 92*c* formed at the end of the first strip 92 is higher with respect to the screen than a second etching boundary 93*c* formed at the end of the second strip 93. Accordingly, the portion of the slot 91 which does not have a dummy bridge passes a deflected electron beam, thereby suppressing a clipping phenomenon.

As shown in FIGS. 9B and 9C, a portion of the slot 91 having dummy bridges is formed such that electron beams cannot pass through the slot 91 in order to increase the clipping of the electron beams.

In other words, with respect to the screen, an etched area at upper end surfaces 94*a* and 95*a* of the first and second dummy bridges 94 and 95 is wider than an etched area at lower end surfaces 94*b* and 95*b* of the first and second dummy bridges 94 and 95. Here, the top surfaces of the first and second dummy bridges 94 and 95 face the screen formed on the front side of the panel 51 of FIG. 5. In addition, the first dummy bridge 94 is nearer to the center of the tension mask 61 than the second dummy bridge 95, and the second dummy bridge 95 is nearer to the periphery of the tension mask 61 than the first dummy bridge 94.

An etched depth at the upper end surface 94*a* of the first dummy bridge 94 is deeper than an etched depth at the upper end surface 95*a* of the second dummy bridge 95. In addition, a central axis Y1 of an etched area at the upper end surfaces 94*a* and 95*a* of the respective first and second dummy bridges 94 and 95 is offset toward the center (in an X2 direction) of the tension mask 61 from a central axis Y2 of the etched area at the lower end surfaces 94*b* and 95*b* of the respective first and second dummy bridges 94 and 95. The offset in the X2 direction prevents a deflected electron beam from passing through the portion of the slot 91 having the dummy bridges 94 and 95. In other words, the offset in the X2 direction increases the clipping of electron beams.

In the portion of the slot 91 having the first and second bridges 94 and 95, the etched depth at the upper end surface 94*a* of the first dummy bridge 94 is deeper than the etched area at the lower end surface 94*b* thereof, and the etched depth at the upper end surface 95*a* of the second dummy bridge 95 is shallower than the etched area at the lower end surface 95*b* thereof. In addition, the etched depth at the upper end surface 94*a* of the first dummy bridge 94 is deeper than the etched depth at the upper end surface 95*a* of the second dummy bridge 95, and the etched depth at the lower end surface 94*b* of the first dummy bridge 94 is shallower than the etched depth at the lower end surface 95*b* of the second dummy bridge 95. Accordingly, a first etching boundary 94*c* formed at the end of the first dummy bridge 94 is lower with respect to the screen than a second etching boundary 95*c* formed at the end of the second dummy bridge 95. Therefore, the portion of the slot 91 having the first and second dummy bridges 94 and 95 blocks deflected electron beams. Briefly, the portion of the slot 91 having the first and second dummy bridges 94 and 95 is etched such that clipping of electron beams can be increased.

During a procedure of passing an electron beam through the slot 64 in the tension mask 61 having such a structure, the electron beam is prevented from landing on a phosphor screen on the inside of a panel corresponding to the real bridge 65, so phosphor cannot be excited. As a result, a black point appears in an image. Since an electron beam does not pass through the portion of the slot 64 having the dummy bridges 66, the distribution of black points is uniform throughout the image so that viewers cannot recognize traces. Consequently, an improvement can be made in overcoming the problem of visibility.

Figure 9D:
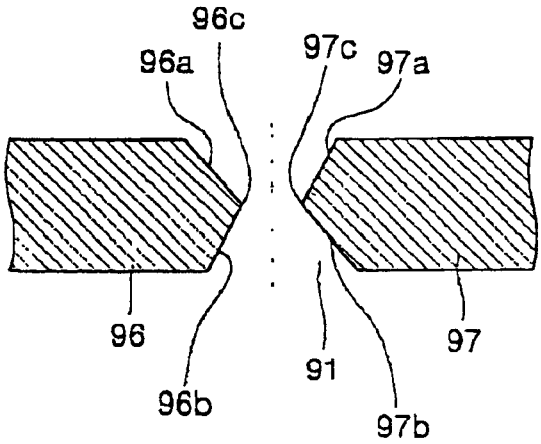
FIG. 9D is a sectional view taken along the line IV—IV of FIG. 8 and shows a state after the etching step according to a first embodiment of the present invention.

FIG. 9D is a sectional view taken along the line IV—IV of FIG. 8 and shows a state after the etching step according to a second embodiment of the present invention. Referring to FIG. 9D, the shape of the section of the end portion of a first dummy bridge 96 and the shape of the section of the end portion of a second dummy bridge 97 are symmetric. In the first and second dummy bridges 96 and 97, an etched depth at each of the upper end surfaces 96*a* and 97*a* is substantially the same as an etched depth at each of the lower end surfaces 96*b* and 97*b*. In other words, in a portion of the slot 91 having the first and second dummy bridges 96 and 97, offset for preventing a deflected electron beam from passing through the slot 91 is zero. Here, the top surfaces of the first and second dummy bridges 96 and 97 face the screen formed on the front side of the panel 51 of FIG. 5.

Figure 10A:
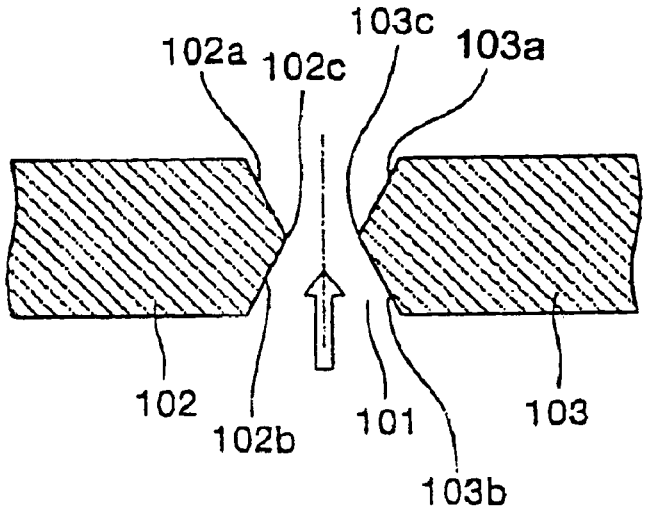
FIG. 10A is a sectional view of the part C of FIG. 6, taken along the line V—V, and shows a portion of a slot in which dummy bridges are formed.
Figure 10B:
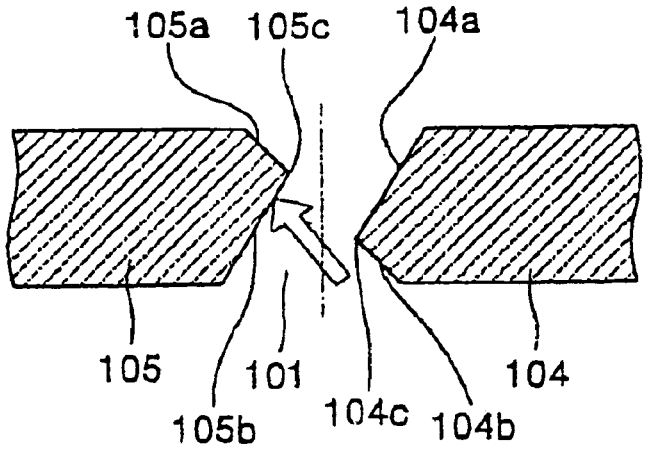
FIG. 10B is a sectional view of the part D of FIG. 6, taken along the line V—V, and shows a portion of a slot in which dummy bridges are formed.
Figure 10C:
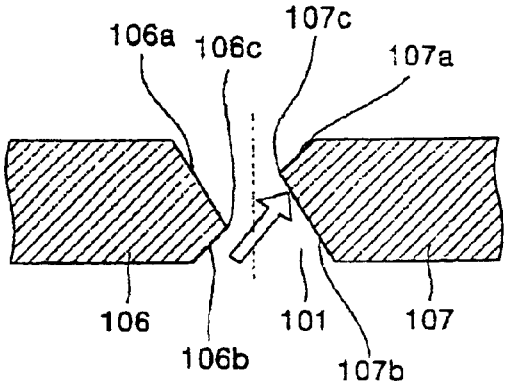
FIG. 10C is a sectional view of the part E of FIG. 6, taken along the line V—V, and shows a portion of a slot in which dummy bridges are formed.

FIG. 10A is a sectional view of the part C of FIG. 6, taken along the line V—V, and shows a portion of a slot having dummy bridges. FIG. 10B is a sectional view of the part D of FIG. 6, taken along the line V—V, and shows a portion of a slot having dummy bridges. FIG. 10C is a sectional view of the part E of FIG. 6, taken along the line V—V, and shows a portion of a slot having dummy bridges.

Referring to FIGS. 10A through 10C, a portion of a slot 101 having first and second dummy bridges is etched such that the amount of clipped electron beams gradually increases from the center of the screen toward the periphery. Here, the first dummy bridge is nearer to the center m of the tension mask 61 than the second dummy bridge, and the second dummy bridge is nearer to the periphery of the tension mask 61 than the first dummy bridge.

In the part C at the center of the tension mask 61, the end portions of first and second dummy bridges 102 and 103, respectively, are symmetric. In the first and second dummy bridges 102 and 103, an etched area at upper end surfaces 102*a* and 103*a* is substantially the same as an etched area at lower end surfaces 102*b* and 103*b*. In other words, offset is zero in the portion of the slot 101 having the first and second dummy bridges 102 and 103. Here, the top surfaces of the first and second dummy bridges 102 and 103 face the screen formed on the front side of the panel 51 of FIG. 5.

In the part D at the left peripheral portion of the tension mask 61, the slot 101 is formed such that an electron beam represented by an arrow cannot pass through the slot 101 in order to increase clipping of the electron beam.

In other words, an etched depth at an upper end surface 104*a* of a first dummy bridge 104 is deeper than an etched depth at an upper end surface 105*a* of a second dummy bridge 105. In contrast, an etched depth at a lower end surface 104*b* of the first dummy bridge 104 is shallower than an etched depth at a lower end surface 105*b* of the second dummy bridge 105. Accordingly, a first etching boundary 104*c* formed at the end of the first dummy bridge 104 is lower with respect to the screen than a second etching boundary 105*c* formed at the end of the second dummy bridge 105 so that an electron beam deflected to the left of the screen cannot pass through the slot 101. Here, the top surfaces of the first and second dummy bridges 104 and 105 face the screen formed on the front side of the panel 51 of FIG. 5.

In the part E at the right peripheral portion of the tension mask 61, the slot 101 is formed Id such that an electron beam represented by an arrow cannot pass through the slot 101 in order to increase clipping of the electron beam.

In other words, an etched depth at an upper end surface 106*a* of a first dummy bridge 106 is deeper than an etched depth at an upper end surface 107*a* of a second dummy bridge 107. In contrast, an etched depth at a lower end surface 106*b* of the first dummy bridge 106 is shallower than an etched depth at a lower end surface 107*b* of the second dummy bridge 107. Accordingly, the portion of the slot 101 having the first and second dummy bridges 106 and 107 is etched so that an electron beam deflected to the right of the screen cannot pass through the slot 101. Here, the top surfaces of the first and second dummy bridges 106 and 107 face the screen formed on the front side of the panel 51 of FIG. 5.

Briefly, portions of slots having first and second dummy bridges are etched such that the degree of offset gradually increases from the center of the screen toward the periphery thereof. As a result, the amount of passed electron beams decreases from the center of the screen toward the periphery thereof.

As described above, in a tension mask assembly for a flat cathode ray tube according to the present invention, the shape of a section of a dummy bridge formed at each slot is formed to block an electron beam so that the problem of visibility can be solved. Therefore, a cathode ray tube of a high definition can be manufactured. In addition, since a portion of a slot having dummy bridges is formed such that an etched area at the upper end surface is wider than an etched area at the lower end surface, the design margin of a dummy bridge is sufficient.

Although the invention has been described with reference to particular embodiments, it will be apparent to one of ordinary skill in the art that modifications to the described embodiments may be made. Accordingly, the scope of the invention will be defined by the spirit of the attached

What is claimed is:

1. A tension mask assembly for a flat cathode ray tube, comprising:

a tension mask comprising a plurality of strips separated from one another by a predetermined gap, real bridges connecting adjacent strips to define slots accommodating electron, beams to pass, and first and second dummy bridges extending from adjacent strips toward each slot therebetween, said tension mask being installed to include a top surface of said tension mask facing a panel forming a screen and being separated from said panel by a predetermined gap;

a plurality of supporting members disposed at opposite sides of said tension mask to support said tension mask; and a plurality of rigid members secured to opposite ends of said supporting members to apply tension to said tension mask, a first etching boundary being formed at an end of said first dummy bridge near to the center of the tension mask being lower with respect to the screen than a second etching boundary formed at an end of said second dummy bridge near to the periphery of said tension mask.

2. The tension mask assembly of claim 1, with the vertical center axis of an etched area at the upper end surfaces of said first and second dummy bridges being offset from the vertical center axis of an etched area at the lower end surfaces of said first and second dummy bridges toward the center of said tension mask to accommodate a deflected electron beam being blocked.

3. The tension mask assembly of claim 1, with an etched area at the upper end surfaces of said first and second dummy bridges being wider than an etched area at the lower end surfaces of said first and second dummy bridges.

4. The tension mask assembly of claim 1, with an etched area at an upper surface above the first etching boundary of said first dummy bridge being wider than an etched area at a lower surface therebelow, and an etched area at a lower surface below the second etching boundary of said second dummy bridge being wider than an etched area at an upper surface thereabove.

5. A tension mask assembly for a flat cathode ray tube, comprising:

a tension mask comprising a plurality of strips separated from one another by a predetermined gap, real bridges connecting adjacent strips to define slots accommodating electron beams to pass, and first and second dummy bridges extending from adjacent strips toward each slot therebetween, said tension mask being installed to include a top surface of said tension mask facing a panel forming a screen and being separated from said panel by a predetermined gap;

a plurality of supporting members disposed at opposite sides of said tension mask to support said tension mask; and a plurality of rigid members secured to opposite ends of said supporting members to apply tension to said tension mask, a first etching boundary being formed at an end of said first dummy bridge near to the center of the tension mask being lower with respect to the screen than a second etching boundary formed at an end of said second dummy bridge near to the periphery of said tension mask, with the vertical center axis of an etched area at the upper end surfaces of said first and second dummy bridges being offset from the vertical center axis of an etched area at the lower end surfaces of said first and second dummy bridges toward the center of said tension mask to accommodate a deflected electron beam being blocked, with the amount of offset increasing from the center of said tension mask toward the periphery of said tension mask.

6. A tension mask assembly, comprising:

a tension mask including a plurality of strips separated from one another by a predetermined gap, real bridges connecting adjacent strips to define slots accommodating electron beams to pass, and first and second dummy bridges extending from adjacent strips toward each slot therebetween, said tension mask being installed to include a top surface of said tension mask facing a panel forming a screen and being separated from said panel by a predetermined gap, a first etching boundary being formed at an end of said first dummy bridge near to the center of the tension mask being lower with respect to the screen than a second etching boundary formed at an end of said second dummy bridge near to the periphery of said tension mask.

7. The tension mask assembly of claim 6, with the vertical center axis of an etched area at the upper end surfaces of said first and second dummy bridges being offset from the vertical center axis of an etched area at the lower end surfaces of said first and second dummy bridges toward the center of said tension mask to accommodate a deflected electron beam being blocked.

8. The tension mask assembly of claim 6, with an etched area at the upper end surfaces of said first and second dummy bridges being wider than an etched area at the lower end surfaces of said first and second dummy bridges.

9. The tension mask assembly of claim 6, with an etched area at an upper surface above the first etching boundary of said first dummy bridge being wider than an etched area at a lower surface therebelow, and an etched area at a lower surface below the second etching boundary of said second dummy bridge being wider than an etched area at an upper surface thereabove.

10. A tension mask assembly, comprising;

a tension mask including a plurality of strips separated from one another by a predetermined gap, real bridges connecting adjacent strips to define slots accommodating electron beams to pass, and first and second dummy bridges extending from adjacent strips toward each slot therebetween, said tension mask being installed to include a top surface of said tension mask facing a panel forming a screen and being separated from said panel by a predetermined gap, a first etching boundary being formed at an end of said first dummy bridge near to the center of the tension mask being lower with respect to the screen than a second etching boundary formed at an end of said second dummy bridge near to the periphery of said tension mask, with the vertical center axis of an etched area at the upper end surfaces of said first and second dummy bridges being offset from the vertical center axis of an etched area at the lower end surfaces of said first and second dummy bridges toward the center of said tension mask to accommodate a deflected electron beam being blocked, with the amount of offset increasing from the center of said tension mask toward the periphery of said tension mask.

11. A tension mask assembly, comprising:

a tension mask, comprising:

a plurality of strips separated from one another by a predetermined gap;

real bridges connecting adjacent strips to define slots accommodating electron beams to pass; and first and second dummy bridges extending from adjacent first and second strips, respectively, toward each slot therebetween, said tension mask being installed to include a top surface of said tension mask facing a panel forming a screen and being separated from said panel by a predetermined gap, with each one of the slots on a first portion of the tension mask including a first etching boundary being formed at an end of the first dummy bridge near to the center of the tension mask being lower with respect to the screen than a second etching boundary formed at an end of the second dummy bridge near to the periphery of said tension mask, and at a section of the slots without the dummy bridges including a third etching boundary being formed at an end of the first strip near to the center of the tension mask being higher with respect to the screen than a fourth etching boundary formed at an end of the second strip near to the periphery of the tension mask; and a first unit supporting and applying tension to said tension mask.

12. The tension mask assembly of claim 11, further comprising a center portion of the tension mask including slots with first and second dummy bridges being symmetric with each other where an etched area at an upper end surface of the first and second dummy bridges is substantially the same as an etched area at lower end surfaces of the first and second dummy bridges.

13. The tension mask assembly of claim 12, further comprising a peripheral portion of the tension mask including slots with a first etching boundary being formed at an end of a first dummy bridge near to the center of the tension mask being lower with respect to the screen than a second etching boundary formed at an end of a second dummy bridge near to the periphery of said tension mask, the first dummy bridge of the peripheral portion being nearer to the center of the tension mask than the second dummy bridge and the second dummy bridge being nearer to the periphery of the tension mask than the first dummy bridge of the peripheral portion.

14. The tension mask assembly of claim 13, with an etched area at the upper end surfaces of said first and second dummy bridges being wider than an etched area at the lower end surfaces of said first and second dummy bridges.

15. The tension mask assembly of claim 14, with an etched area at an upper surface above the first etching boundary of said first dummy bridge being wider than an etched area at a lower surface therebelow, and an etched area at a lower surface below the second etching boundary of said second dummy bridge being wider than an etched area at an upper surface thereabove.

16. The tension mask assembly of claim 15, with the etched area at the top surfaces of the first and second strips being wider than the etched area at the lower surface of the first and second strips where the top surfaces of the first and second strips face the screen.

17. The tension mask assembly of claim 16, with the vertical center axis of an etched area at the upper end surfaces of said first and second dummy bridges being offset from the vertical center axis of an etched area at the lower end surfaces of said first and second dummy bridges toward the center of said tension mask to accommodate a deflected electron beam being blocked, with the amount of offset increasing from the center of said tension mask toward the periphery of said tension mask.

18. The tension mask assembly of claim 11, with the vertical center axis of an etched area at the upper end surfaces of said first and second dummy bridges being offset from the vertical center axis of an etched area at the lower end surfaces of said first and second dummy bridges toward the center of said tension mask to accommodate a deflected electron beam being blocked.

19. The tension mask assembly of claim 18, with the amount of offset increasing from the center of said tension mask toward the periphery of said tension mask.

20. A tension mask assembly, comprising:

a tension mask, comprising:

a plurality of strips separated from one another by a predetermined gap;

real bridges connecting adjacent strips to define slots accommodating electron beams to pass; and first and second dummy bridges extending from adjacent first and second strips, respectively, toward each slot therebetween, said tension mask being installed to include a top surface of said tension mask facing a panel forming a screen and being separated from said panel by a predetermined gap, an etched depth at each one of the upper end surfaces of the first and second dummy bridges being substantially the same as an etched depth at each one of the lower end surfaces of the first and second dummy bridges where the first dummy bridge is near to the center of the tension mask and the second dummy bridge is near to the periphery of said tension mask, and a portion without the dummy bridges of each of the slots including a third etching boundary being formed at an end of the first strip near to the center of the tension mask being higher with respect to the screen than a fourth etching boundary formed at an end of the second strip near to the periphery of said tension mask; and a first unit supporting and applying tension to said tension mask.

* * * * *